United States Patent [19]

Nichol, Jr.

[11] Patent Number: 5,014,957

[45] Date of Patent: May 14, 1991

[54] HOSIERY DISPLAY HANGER ASSEMBLY

[76] Inventor: William H. Nichol, Jr., 123 W. 7th St., Hopkinsville, Ky. 42240

[21] Appl. No.: 355,999

[22] Filed: May 23, 1989

[51] Int. Cl.[5] ..... B42F 13/00

[52] U.S. Cl. ..... 248/340; 206/806; 223/85

[58] Field of Search ..... 248/340; 223/85, 87, 223/DIG. 2, DIG. 4; 211/113; 206/292, 296, 477, 806, 285, 289, 293, 294, 278

[56] References Cited

U.S. PATENT DOCUMENTS

| | | | |
|---|---|---|---|
| 2,523,682 | 9/1950 | Corwin . | |
| 2,709,006 | 5/1955 | Ludwig . | |
| 2,755,013 | 7/1956 | Beede . | |
| 3,037,621 | 6/1962 | Jackman . | |
| 3,462,068 | 8/1969 | Suominen | 223/85 X |
| 3,469,679 | 9/1969 | Kamins et al. . | |
| 3,486,683 | 12/1969 | Kamins | 248/340 X |
| 3,542,170 | 11/1970 | Bialo . | |
| 3,692,269 | 9/1972 | Hales . | |
| 3,783,995 | 1/1974 | Tobin . | |
| 3,809,194 | 5/1974 | Chappelle et al. . | |
| 3,900,181 | 8/1975 | Pitanis . | |
| 3,997,091 | 12/1976 | Burnette | 206/296 X |
| 3,999,656 | 12/1976 | Hydorn . | |
| 4,189,049 | 2/1980 | Silver | 206/806 X |
| 4,219,140 | 8/1980 | Simonoff . | |
| 4,266,677 | 5/1981 | Dewsnap | 223/85 X |
| 4,593,812 | 6/1986 | Dillingham . | |
| 4,601,417 | 7/1986 | Kunreuther . | |
| 4,718,546 | 1/1988 | Kolton et al. . | |
| 4,759,440 | 7/1988 | Kolton et al. . | |
| 4,765,467 | 8/1988 | Kolton et al. . | |
| 4,768,649 | 9/1988 | Kolton et al. . | |

FOREIGN PATENT DOCUMENTS

| | | | |
|---|---|---|---|
| 2261933 | 9/1975 | France | 223/87 |
| 2399365 | 4/1979 | France | 206/296 |

OTHER PUBLICATIONS

Conventional Hook-Type Hanger for Plastic Bag, Manufactured by Rhyne & Co., Address Unknown, Telephone No. 615-265-0568.

Conventional Hook-Type Hanger, Manufacturer Unknown, Date Unknown.

*Primary Examiner*—J. Franklin Foss

*Attorney, Agent, or Firm*—Shefte, Pinckney & Sawyer

[57] ABSTRACT

A hanger assembly for supporting multiple pairs of socks or other hosiery in suspended disposition from a conventional sock retailing display fixture is provided. The hanger assembly includes an elongate main body portion and a longitudinally centered fixture attachment hook-shaped portion integrally formed from plastic. The main body includes a plurality of sock attachment openings spaced along the longitudinal extent thereof in balanced relation to the hanging axis of the main body and a corresponding plurality of plastic fasteners for attaching the sock pairs to the main body at each sock attachment location for balanced suspension of the multiple sock pairs.

4 Claims, 2 Drawing Sheets

HOSIERY DISPLAY HANGER ASSEMBLY

BACKGROUND OF THE INVENTION

The present invention relates generally to a hosiery display hanger assembly and, more particularly, to such an assembly for supporting a plurality of sock pairs from a conventional sock retailing display fixture.

One preferred means of displaying pairs of socks in retail establishments is to suspend the socks from a display fixture using a hanger device which leaves all or a substantial portion of the sock exposed. This method permits the potential purchaser to touch and examine the sock as well as offering the potential purchaser an immediate visual basis of comparison between the various sock pairs on display so that the purchaser may readily determine the appropriate color, fabric and construction of the sock pair desired to be purchased.

A number of hanger devices have been proposed for displaying socks in this fashion. Perhaps the most popular hanger device in current use is a single plastic hook having a hole at the lower end of the hook for receiving a plastic fastener inserted through the folded pair of hosiery to be suspended.

Other devices for suspending socks from a rack or the like are disclosed in U.S. Pat. No. 3,900,181 to Pitanis and U.S. Pat. No. 4,601,417 to Kunreuther. The Pitanis patent discloses a dual purpose sock holder which includes a retaining member and a hanger member formed as an integral unit from plastic material. The retainer member includes a pair of transverse openings for retaining hose draped through the openings. The Kunreuther patent discloses a hosiery tag which includes first and second side portions joined by an intermediate portion, the first and second side portions being adapted to be aligned in spaced, substantially parallel relation to one another for receiving a folded pair of hosiery inserted therebetween. A plastic fastener is inserted through aligned holes in the side portions adjacent their free ends and a hook part is secured to the intermediate portion for suspending the hosiery tag and folded sock pair combination from a retail display rack.

Another type of device for displaying socks in a retail establishment is a device including a clear plastic bag in which plural pairs of socks are contained and a one-piece plastic display hanger having a hook portion and a thin elongated body extending laterally therefrom for supporting an upper margin of the clear plastic bag.

However, these known devices for supporting and displaying sock pairs in a retail establishment each suffer from disadvantages such as undue complexity in design and manufacture, inadequate protection against the inadvertent or intentional removal of sock pairs supported thereon, such as removal by shoplifting, little or no capacity for simultaneously supporting and displaying a plurality of sock pairs and an undesirable tendency to support the sock pairs in an unbalanced manner.

SUMMARY OF THE INVENTION

Accordingly, the present invention provides a hosiery display hanger assembly for supporting a plurality of hosiery items in suspended disposition from a conventional retailing display fixture in a balanced manner and in a disposition in which the potential purchaser can readily touch and examine the hosiery. Additionally, the present invention provides a hanger assembly having a relatively simple design which readily lends itself to enhancing the efficiency and cost effectiveness of the hosiery packaging operation.

Briefly described, the present invention provides a hosiery display hanger assembly for supporting at least two pairs of socks or other hosiery in a suspended disposition from a conventional retailing display fixture. The hanger assembly includes a main body, fastener means and fixture attachment means. The main body has a longitudinal extent and a central hanging axis transverse to its longitudinal extent and a plurality of hosiery attachment locations spaced along its longitudinal extent in balanced relation to the central hanging axis. The fastener means is adapted for attaching at least one hosiery pair to the main body at each attachment location. The fixture attachment means is associated with the main body in centered relation to the central hanging axis and is configured for mounting engagement with the display fixture for suspension of the main body and hosiery pairs therefrom with the longitudinal extent of the main body in a generally horizontal disposition.

In the preferred embodiment, the fixture attachment means includes a hook-shaped portion for hanging engagement from the display fixture with the main body portion and the hook-shaped portion integrally formed of plastic in a planar sheet form. Each attachment location comprises an opening in the main body, the fastener means comprising a plurality of thin elongate plastic fasteners each having enlarged ends for penetrating a hosiery pair and for receipt within one opening in the main body of the hanger assembly.

DETAILED DESCRIPTION OF THE PREFERRED EMBODIMENT

Figure 1:
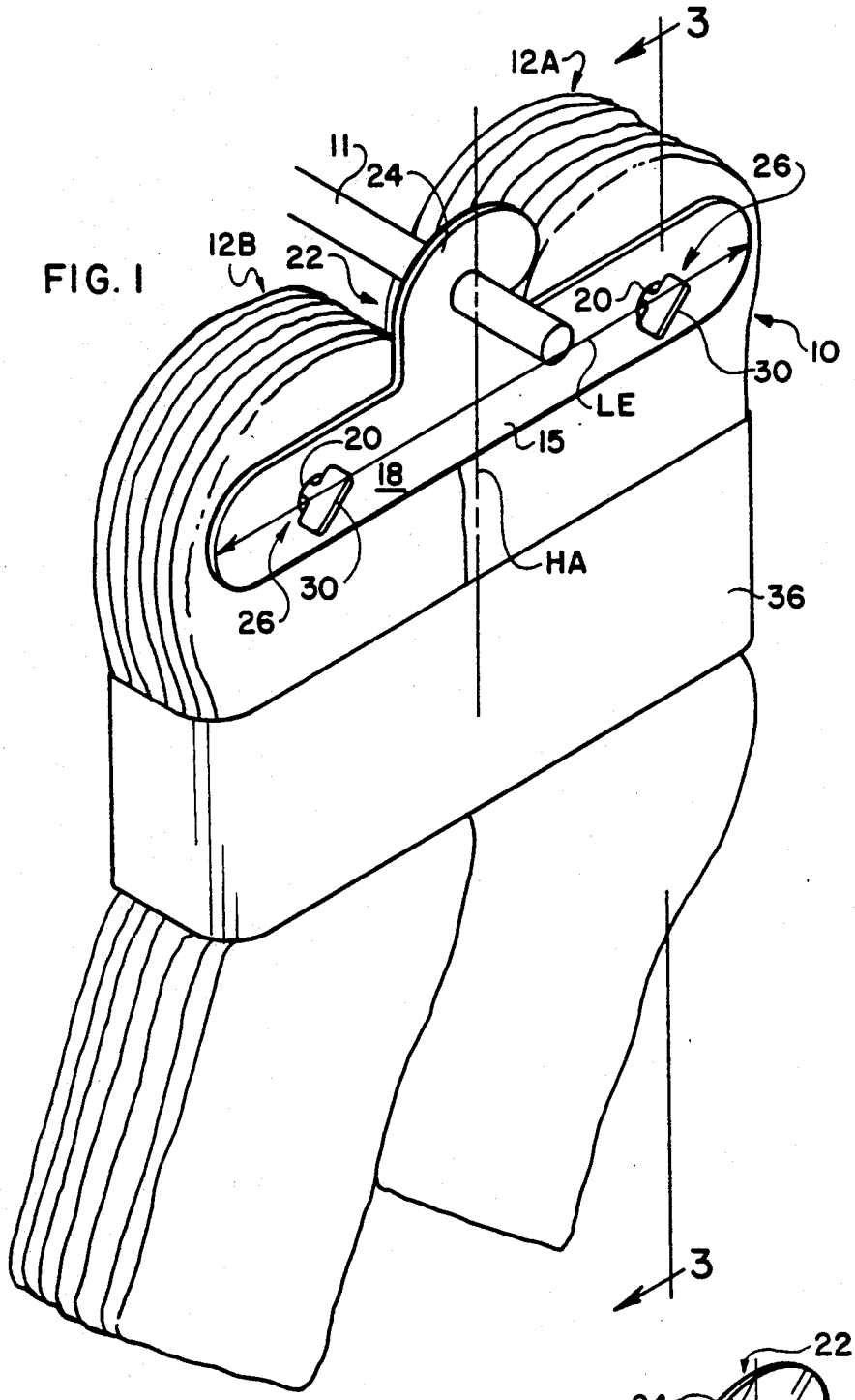
FIG. 1 is a perspective view of the preferred embodiment of the sock hosiery hanger assembly of the present invention, shown in use for suspending a plurality of pairs of socks from a conventional sock retail display fixture.
Figure 2:
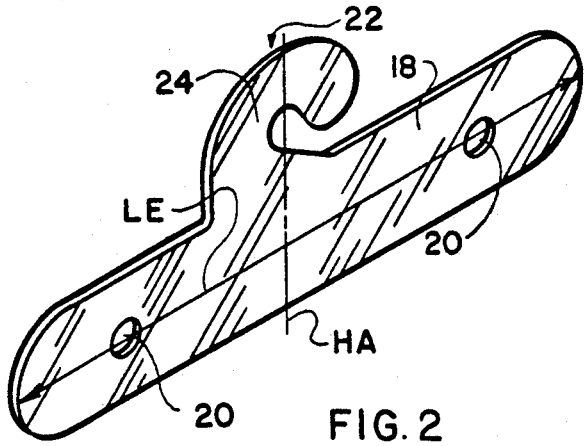
FIG. 2 is a perspective view of the main body and the fixture attachment portion of the hanger assembly shown in FIG. 1.
Figure 3:
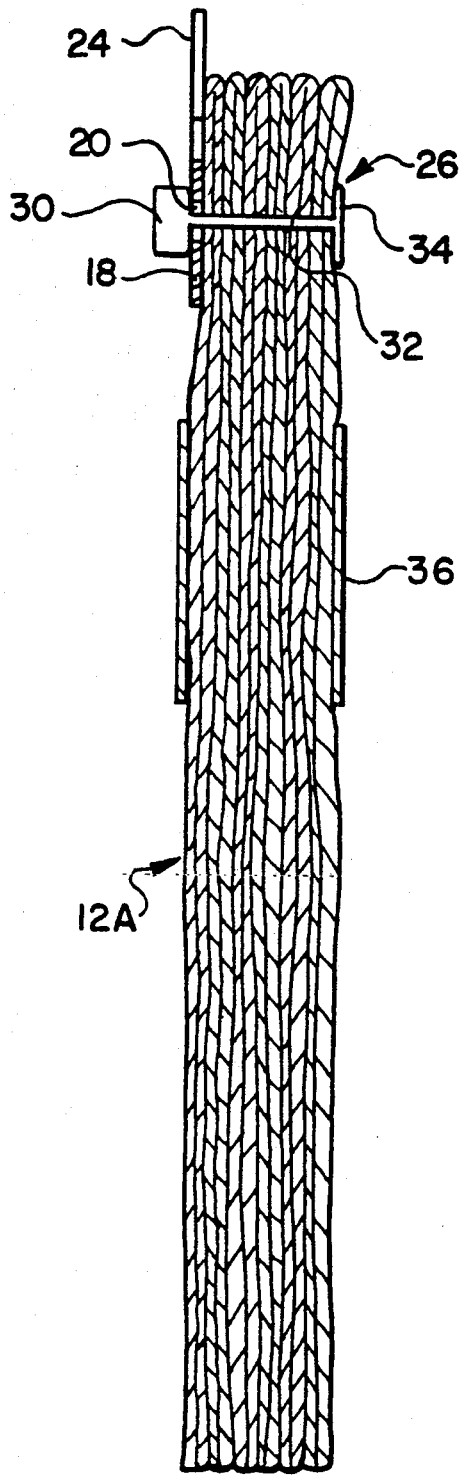
FIG. 3 is a side elevational view of the hanger assembly shown in FIG. 1, taken along line 3—3 thereof.

In the accompanying drawings, the preferred embodiment of the hosiery hanger assembly of the present invention is illustrated and generally designated as 10. The hanger assembly 10 is adapted to support multiple pairs of substantially any type of hosiery and, in particular, socks, as representatively designated as 12A and 12B, in a balanced suspended disposition from a conventional hosiery retailing display fixture representatively indicated only at 11. By way of example, the hanger assembly 10 is illustrated in the drawings as supporting six pairs of socks in two sets of three pairs each, but it will be understood that a greater or lesser number of pairs may be supported as desired. Basically, the hanger assembly 10 includes a hanger member 15 and a pair of fasteners 26 for attaching each set of the sock pairs 12A, 12B, respectively, to the hanger member 15.

The hanger member 15 includes a main body portion 18 and a fixture attachment portion 22. The main body portion 18 has an elongate longitudinal extent LE and a central hanging axis HA perpendicular to the longitudinal extent LE. The main body portion 18 includes a pair of sock attachment locations 20 having the form of circular openings adapted to receive the fasteners 26, the sock attachment locations 20 being spaced along the longitudinal extent LE equidistantly from opposite sides of the central hanging axis HA to be in balanced relation to the central hanging axis HA. The fixture attachment portion 22 of the sock hanger assembly 10 is affixed or otherwise associated with the main body portion 18 in centered relation to the central hanging axis HA. Preferably, the fixture attachment portion 22 is configured in the form of a hook 24 to engage and hang from the sock retailing display fixture 11. Advantageously, the hook 24 and the main body portion 18 may be conveniently formed integrally from a planar sheet of plastic, such as by a conventional stamping or molding process.

Each fastener 26 is of a well-known conventional construction comprising an integral plastic member having a thin, generally cylindrical, elongated body stem 32 with an enlarged generally rectangular retainer portion 30 at one end and a cross-bar retainer portion 34 at the other end, each retainer portion 30, 34 having a transverse extent relative to the body stem 32 slightly greater than the individual diameters of the sock attachment openings 20. The elongate body stem 32 and the cross-bar retaining portion 34 of each fastener 26 are sufficiently thin to penetrate the socks 12A, 12B without damages thereto and the body stem 32 is of a longitudinal dimension sufficient to extend entirely through all of the sock pairs to be mounted at one attachment opening 20.

Each plastic fastener 26 is assembled with a respective set of the sock pairs 12A, 12B and with the hanger member 15 such that the generally rectangular retainer portion 30 abuts the outward face of the main body portion 18 at a respective sock attachment location 20, the cylindrical elongate body stem 32 projects through the sock attachment opening 20 and extends through the set of sock pairs at generally the same location on each sock, preferably at about the radial midpoint of the toe portion of each sock pair, and the cross-bar retainer portion 34 generally transversely engages the sock outermost from the main body portion 18, thereby holding the socks of the respective set in adjacent abutting relation to one another. Known devices are conveniently available for injecting fasteners of this type through the sock attachment openings 20 and through the socks 12A, 12B, in the described disposition.

In this manner, the plastic fasteners 26 securely fasten their respective sets of plural sock pairs to the main body portion 18, the centered disposition of the hook 24 at the hanging axis HA and the spacing of the sock attachment locations 20 equidistantly from the hanging axis HA causing the sock pairs 12A, 12B to hang in balanced suspension from the display fixture 11 with the elongate extent LE of the main body portion 18 in a generally horizontal disposition. Preferably, the spacing of the sock attachment locations 20 from one another is selected in correspondence with the cross-sectional or diametrical width of the toe regions of the sock pairs so that the sock pairs 12A, 12B hang in mutually side-abutting relation to one another. This arrangement provides a pleasing aesthetic symmetry when the sock pairs are displayed on the display fixture 11 as well as contributing to a secure and balanced suspension of the sock pairs from the main body portion 18. As desired, a paper band 36 of conventional construction having an inward sticky surface and an outward surface imprinted with advertising, labeling and such thereon, can be provided for encircling the abutting sock pairs at a location spaced below the main body portion 18. Advantageously, the sock hanger assembly 10 of the present invention resists efforts to tamper with or remove individual sock pairs supported thereby since the sock pairs are bound together by the plastic fasteners 26 as well as by the band 36.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A hosiery display hanger assembly for supporting at least two pairs of hosiery in a suspended disposition from a conventional hosiery retailing display fixture, comprising:

a main body having a longitudinal extent and a central hanging axis transverse to said longitudinal extent, said main body having a plurality of hosiery attachment locations spaced along said longitudinal extent in a balanced relation to said hanging axis;

a plurality of pairs of hosiery;

a plurality of fastener means corresponding in number to said plurality of hosiery attachment locations, each said fastener means attaching at least one hosiery pair to said main body at a respective one of said hosiery attachment locations for free suspension of each hosiery pair from said main body;

fixture attachment means associated with said main body in centered relation to said hanging axis and configured for mounting engagement with the display fixture for suspension of said main body and hosiery pairs therefrom with said longitudinal extent of said main body in a generally horizontal disposition;

each said hosiery attachment location comprising an opening in said main body for receipt of one said fastener means, and each said fastener means including a plastic fastener having a thin elongate body for penetrating a hosiery pair without damage thereto and enlarged retainer portions at opposite ends of said elongate body.

2. A hosiery hanger assembly according to claim 1 and characterized further in that said fixture attachment means includes a hook-shaped portion.

3. A hosiery hanger assembly according to claim 1 and characterized further in that said main body and said fixture attachment means are integrally formed.

4. A hosiery hanger assembly according to claim 3 and characterized further in that said main body and said fixture attachment means are integrally formed of plastic in planar sheet form.

* * * * *